US005272895A

United States Patent [19]

Best

[11] Patent Number: 5,272,895

[45] Date of Patent: * Dec. 28, 1993

[54] HIGH SECURITY KEY AND CYLINDER LOCK ASSEMBLY

[75] Inventor: Walter E. Best, Indianapolis, Ind.

[73] Assignee: Best Lock Corporation, Indianapolis, Ind.

[ * ] Notice: The portion of the term of this patent subsequent to Aug. 11, 2009 has been disclaimed.

[21] Appl. No.: 891,645

[22] Filed: May 29, 1992

Related U.S. Application Data

[63] Continuation of Ser. No. 678,855, Mar. 29, 1991, Pat. No. 5,136,869.

[51] Int. Cl.[5] ..... E05B 19/02; E05B 27/04

[52] U.S. Cl. ..... 70/369; 70/375; 70/406; 70/407; 70/408

[58] Field of Search ..... 70/369, 375, 402, 405–409, 70/492–495

[56] References Cited

U.S. PATENT DOCUMENTS

| | | | |
|---|---|---|---|
| D. 278,880 | 5/1985 | Widen | D8/347 |
| 851,008 | 4/1907 | Jacobson et al. | 70/409 |
| 929,668 | 8/1909 | Hartman | 70/375 |
| 1,782,464 | 11/1930 | Falk | 70/406 |
| 1,886,822 | 11/1932 | Main | 70/375 |
| 1,958,603 | 5/1934 | Bacon | 70/406 |
| 1,996,811 | 4/1935 | Jacobi | 70/406 |
| 2,059,129 | 10/1936 | Maxwell et al. | 70/419 |
| 2,083,859 | 6/1937 | North | 70/408 |
| 2,418,080 | 3/1947 | Ledin et al. | 70/408 |
| 2,733,590 | 2/1956 | Crumb | 70/402 |
| 2,803,959 | 8/1957 | Schlage | 70/347 |
| 2,807,158 | 9/1957 | Best | 70/369 X |
| 3,324,694 | 6/1967 | Tornoe | 70/408 |
| 3,479,848 | 11/1969 | Golden | 70/495 |
| 3,605,463 | 9/1971 | Epstein | 70/419 X |
| 3,780,549 | 12/1973 | Schlage | 70/408 X |
| 4,294,093 | 10/1981 | Best et al. | 70/369 |
| 4,386,510 | 6/1983 | Best et al. | 70/369 |
| 4,578,969 | 4/1986 | Larson | 70/366 |
| 4,683,740 | 8/1987 | Errani | 70/419 |
| 4,787,225 | 11/1988 | Hauser et al. | 70/401 |
| 5,029,459 | 7/1991 | Almblad | 70/408 X |
| 5,136,869 | 8/1992 | Best | 70/369 |

FOREIGN PATENT DOCUMENTS

| | | | |
|---|---|---|---|
| 258614 | 4/1965 | Australia . | |
| 220505 | 3/1962 | Austria . | |
| 0305953 | 3/1989 | European Pat. Off. . | |
| 404232 | 10/1924 | Fed. Rep. of Germany | 70/375 |
| 8829 | of 1913 | United Kingdom . | |
| 181429 | 6/1922 | United Kingdom . | |
| 1355188 | 6/1974 | United Kingdom . | |

*Primary Examiner*—Lloyd A. Gall

*Attorney, Agent, or Firm*—Barnes & Thornburg

[57] ABSTRACT

A cylinder lock assembly includes a core, a key plug mounted for rotation in the core, and a key. The key plug is formed to include a keyway and a plurality of tumbler pin bores opening into the keyway. The key has a bow and a blade appended to the bow. The blade includes a bitted portion and includes a stop shoulder at the tip of the blade for positioning the bitted portion in alignment with the tumbler pin bores. A separate drive member is provided on the key for rotating the key plug relative to the core to actuate the cylinder lock assembly. The drive member is located between the bitted portion and the bow and is configured to cooperate with a bottom portion of the key blade to provide the primary torque or force for rotating the key plug in response to turning of the key in the cylinder lock assembly so that the bitted portion and an offset portion of the blade not carry substantial torque transmission load between the key and the key plug to rotate the key plug in the core.

37 Claims, 3 Drawing Sheets

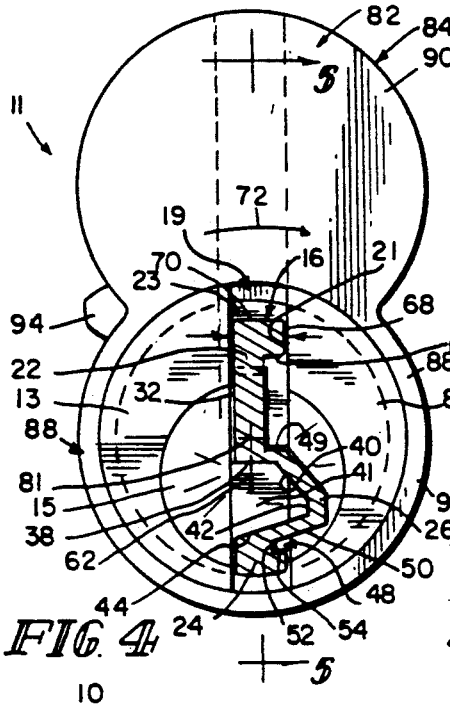
FIG. 4
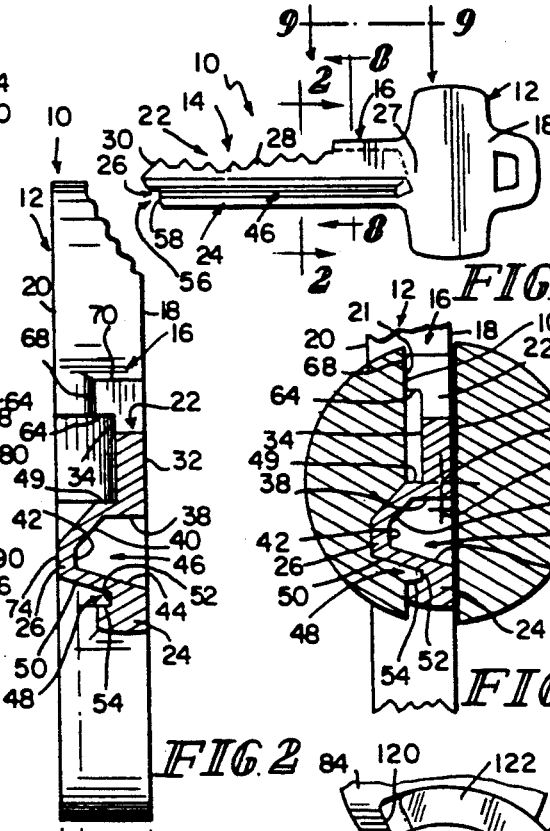
FIG. 1
FIG. 2
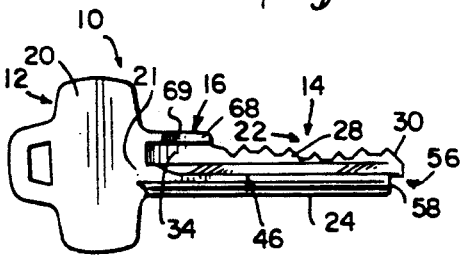
FIG. 3
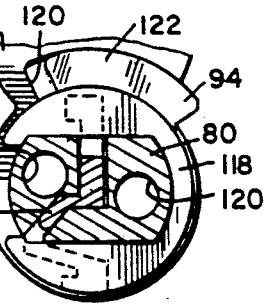
FIG. 6
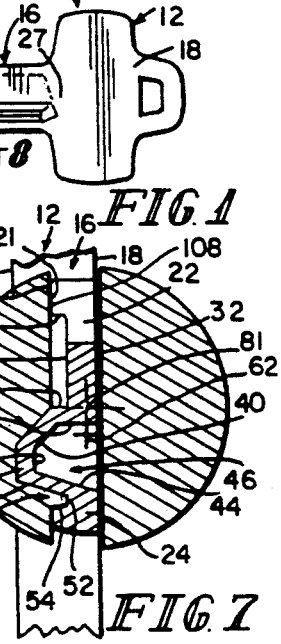
FIG. 7
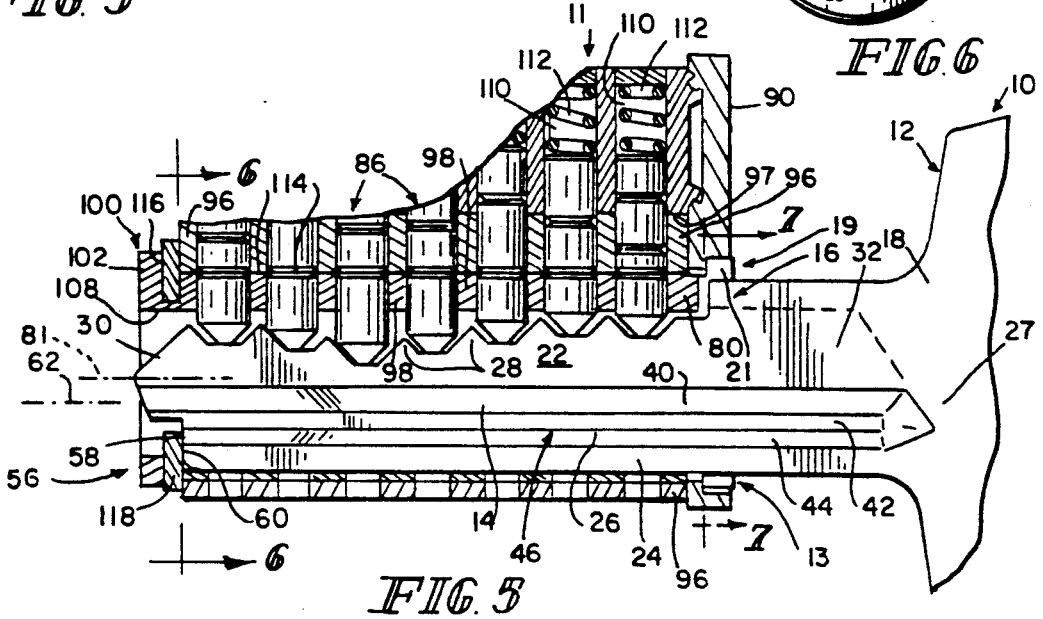
FIG. 5

HIGH SECURITY KEY AND CYLINDER LOCK ASSEMBLY

This is a continuation of application Ser. No. 07/678,855 filed Mar. 29, 1991, now U.S. Pat. No. 5,136,869, issued Aug. 11, 1992.

BACKGROUND AND SUMMARY OF THE INVENTION

The present invention relates to a cylinder lock assembly including a rotatable key plug and a key for rotating the key plug. More particularly, the present invention relates to a key having a key plug drive shoulder located and configured to minimize the torque load on the key blade as the key is turned to rotate the key plug and actuate the cylinder lock assembly.

In the design of cylinder lock assemblies, it is important that the security of the lock be maintained even when parts of the lock are subjected to deliberate excessive torque during an attack on the lock. The lock should also be designed to withstand the inadvertent application of excessive torque which, for example, could be applied by a user who attempts to turn a key forcibly to actuate the lock when the lock is jammed or otherwise inoperative.

Many conventional keys are designed to flex or even snap apart when turned too hard by a user so that excessive torque cannot be transmitted to the locking mechanism through the key and damage to the locking mechanism is prevented. In effect, the key is designed to be the weakest part of the lock to protect the structural integrity of the mechanism of the lock from damage during a deliberate or inadvertent attack using a key.

At the same time, the key should also be able to withstand normal torque applied by a user operating a lock. Many hard-to-duplicate keys of the type used in high security locks have blades which tend to bend or break during normal key usage. This problem frustrates consumers who wish to have a key that is not easily duplicated or broken and is usable in a high security lock.

A key that was configured to impart a driving force to rotate the key plug in the core without excessive flexure of the blade during normal use would be an improvement over conventional keys. This objective is especially important in situations in which security or other considerations dictate that the key blade have a cross-sectional shape that effectively reduces its torque transmission capability during normal usage. For example, in a key blade including a portion having a cross-sectional width which is thinner and torsionally weaker than similar portions of conventional keys, considerations of flexure and breakage of the key blade during normal usage may well be critical.

According to the present invention, a cylinder lock assembly includes a core, a rotatable key plug mounted in the core, and a key. The key plug is formed to include a keyway and a plurality of tumbler pin bores opening into the keyway. The key includes a bow and a blade appended to the bow. The blade includes a top edge formed to include a bitted portion for lifting the tumbler pins to a predetermined position in the tumbler pin bores to permit rotation of the key plug in the core upon rotation of a key inserted into the keyway.

The key further includes drive means for providing the primary torque to rotate the key plug relative to the core to actuate the cylinder lock assembly in response to rotation of the key about its longitudinal axis by a user seeking to unlock the cylinder lock assembly. The drive means includes a drive shoulder extending above the top edge of the blade and a bottom edge of the blade. The drive means and key plug are proportioned and configured such that the drive means drivingly engages the key plug and serves as the primary drive force for rotating the key plug. The "primary torque" or "primary drive force" is sufficient to rotate the key plug to activate the lock assembly.

In preferred embodiments, the key includes a key stop at the end of the key for engaging the key plug to position the bitted portion of the blade in alignment with tumbler pin bores opening into the keyway following insertion of the key into the keyway. The key stop is located at the tip of the blade in spaced relation to the drive shoulder. The drive shoulder is located at the throat of the key adjacent to the bow and is oriented to project away from the bottom edge of the blade to lie in an outer slot formed in the key plug.

The key stop also functions to place the drive shoulder in registry with a drive-receiving portion located in the outer slot of the key plug. The drive-receiving portion is configured to engage the drive shoulder. As the key is turned in the keyway, the drive shoulder engages the drive-receiving portion in the outer slot of the key plug to rotate the key plug in the core and actuate the lock. The drive-receiving portion of the key plug is located in a vertical slot formed in the front end of the key plug so that the drive shoulder engages a side wall of the vertical slot when the key is turned. The drive shoulder is rigid and cooperates with the bottom edge of the blade to provide the primary means for applying torque or drive force to rotate the key plug in response to turning of the key. As a result, the torque load on the rest of the blade (e.g., the bitted portion and an offset portion extending between the top and bottom edges along the length of the blade) is minimized because the rest of the blade does not carry substantial torque transmission load between the key and the key plug during turning of the key to rotate the key plug in the core. That torque load is carried primarily by the drive shoulder and the bottom edge of the blade.

One aspect of the present invention is that the torque applied by the user to rotate the key plug relative to the core and actuate the cylinder lock assembly is transmitted primarily through the drive means provided on the key instead of being transmitted only through the blade itself. In use, the stop means on the distal end of the key blade stops the key at the proper place in the keyway to position the drive shoulder in snug driving engagement with the drive-receiving surface on the key plug and the bottom edge of the blade in snug driving engagement with the key plug. Once the key is turned by a user, torque is transmitted to rotate the key plug and actuate the cylinder lock assembly by driving engagement of the drive shoulder and the bottom edge on the key against the key plug.

The drive shoulder and the bottom edge on the key are sturdy and can withstand a lot of impact during rotation of the key in-the keyway by the user even if the key blade as a whole is somewhat weak and fragile. Advantageously, the drive means receives the brunt of the force applied to the key during use, thereby minimizing the magnitude of force applied to fragile or weak portions of the blade and the risk that the key blade will be bent, twisted, or broken during normal usage. Thus, the key blade of a key made in accordance with the present invention can be made to have a middle or offset portion characterized by a very thin width in cross-section because the key plug will be rotated primarily by the drive means rather than the middle or offset portion of the key blade. In many applications, it is preferable to make a key blade having a relatively thin width in cross-section in the middle of the blade because a greater variety of key blade and keyway shapes can be designed and produced.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

FIG. 1 is a side elevation view of a key in accordance with the present invention showing a key stop at the tip of the key blade and a drive shoulder positioned between the key bow and the bitted portion on the key blade;

FIG. 2 is an enlarged end view taken along lines 2—2 of FIG. 1 from a point looking toward the key bow and showing the key bow (nearly) in full and the key blade in section to illustrate the thin cross-section width and offset configuration of a middle portion of the key blade;

FIG. 3 is another side elevation view of the key of FIG. 1 taken from a different vantage point showing the drive-imparting surface of the drive shoulder;

FIG. 4 is an enlarged front view of a cylinder lock assembly in accordance with the present invention showing a figure-8-shaped core and a key plug mounted for rotation in the lower lobe of the core and formed to include a keyway containing the key illustrated in FIGS. 1-3;

FIG. 5 is a sectional view taken along line 5—5 of FIG. 4 showing the key of FIGS. 1-4 positioned in the keyway by engagement of the key stop against the key plug to align the bitted portion of the key blade properly under the tumbler pins and to align the drive-imparting surface of the drive shoulder adjacent to a drive-receiving surface in an outer slot formed in the key plug outside the mouth of the blade-receiving keyway;

FIG. 6 is a rear sectional elevation view taken along line 6—6 of FIG. 5 showing a portion of the distal end of the key blade in the keyway and the two apertures formed in the key plug for receiving the two legs of a throw pin;

FIG. 7 is a sectional view taken along line 7—7 of FIG. 5 showing the drive-imparting surface of the key positioned to lie next to the drive-receiving surface in the outer slot of the key plug following insertion of the blade fully into the keyway;

DETAILED DESCRIPTION OF THE DRAWINGS

Figure 8A:
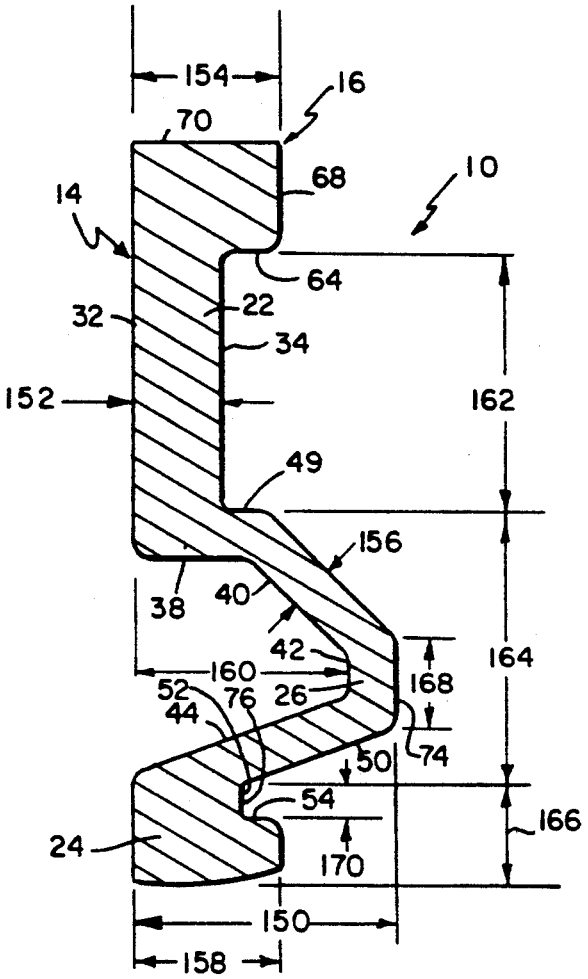
FIG. 8*a* is an enlarged "dead section" view of the key taken along line 8—8 of FIG. 1 showing illustrative dimensions of the key blade.

A key 10 for use in a cylinder lock 11 according to the present invention is shown in FIGS. 1-3. Cylinder lock 11 includes a cylindrical key plug 80 mounted for rotation in the lower lobe 88 of a figure-8-shaped lock core 82 as shown best in FIG. 4. Cylinder lock 11 can be unlocked by inserting key 10 into the keyway 108 formed in key plug 80 and turning key 10 to rotate key plug 80 relative to lock core 82.

Figure 10:
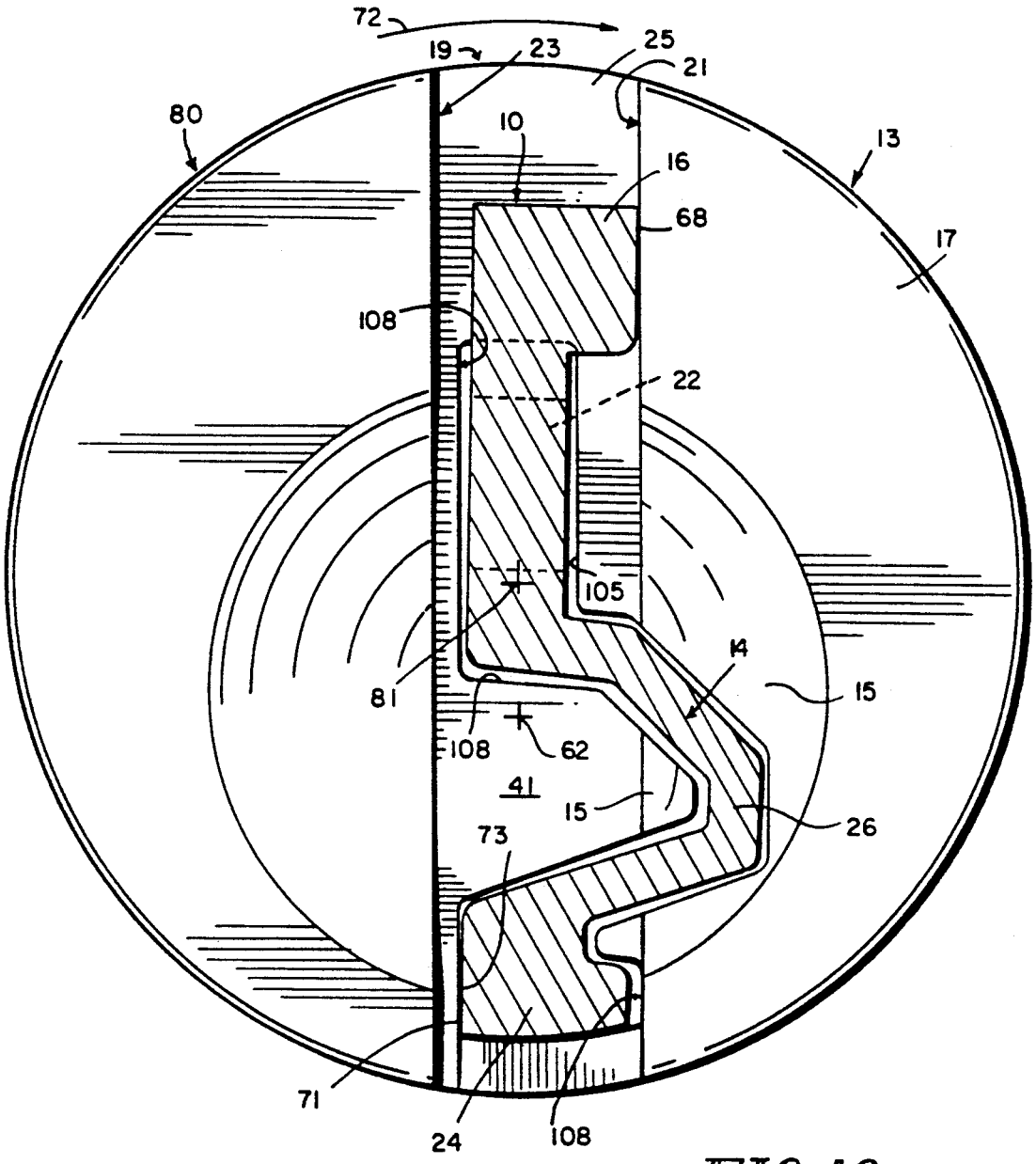
FIG. 10 is an enlarged view of the key plug illustrated in FIG. 1 showing engagement of the drive shoulder and the bottom edge of the blade against the key plug and the gap between the middle portion of the blade and the key plug after the user starts to turn the key in a clockwise direction in the keyway.

The configuration of the front end of key plug 80 is shown best in FIGS. 4 and 10. The key 10 is shown in a relaxed position in FIG. 4 after it has been inserted into keyway 108 but before it has been turned by a user about axis 62. The key 10 is shown in a flexed, torqued position in FIG. 10 just after it has been turned by a user but-before it has been turned enough to cause the key plug 80 to rotate relative to the lock core 82.

Referring to FIG. 10, key plug 80 includes a circular front face 13 having a round concave depression 15 in the center, an annular flat face 17 around the border of the concave depression 15, and a vertical slot 19 extending along a diameter of the circular front face 13. The vertical slot 19 includes a right side wall 21, a left side wall 23, and a flat bottom wall 25. The left and right side walls 21, 23 are engaged by sturdy portions of the key 10 described below as the key 10 is turned in the keyway 108 to rotate the key plug 80 relative to lock core 82.

The key 10 includes a bow 12 providing a hand grip for a user, a blade 14 adapted for insertion into cylinder lock 11, a stop shoulder 56 for limiting movement of key 10 into the keyway 108 formed in the key plug 82, and a drive shoulder 16 to engage the key plug 80 in vertical slot 19 to actuate the lock upon turning of key 10 by the user. The key 10 is constructed of a conventional silver nickel material, such as leaded nickel-silver alloy 782.

Stop shoulder 56 is formed near the distal tip of blade 14 and drive shoulder 16 is located at a proximal portion of the blade 14 adjacent to the bow 12. The separate stop shoulder 56 is provided to ensure that the key blade 14 is registered properly in the keyway 108 each time it is used to actuate cylinder lock 11. Thus, drive shoulder 16 is not configured to engage the key plug 80 to limit movement of key blade 14 into keyway 108. The function of drive shoulder 16 is to provide means on the key 10 for transmitting torque to the key plug 80 to lessen or minimize torque applied to the key blade 14 during turning of key 10 to actuate cylinder lock 11.

Drive shoulder 16 is positioned in the vertical slot 19 formed in the front face 13 of key plug 80 automatically by action of the stop shoulder 56 on the distal end of the blade 14 to limit movement of the blade 14 into keyway 108 and therefore align the blade 14 in a proper registered position within the keyway 108. As show best in FIG. 5, drive shoulder 16 lies in vertical slot 19 when the key blade 14 is properly inserted into key plug 80 and does not extend into the keyway 108. Drive shoulder 16 includes a drive-imparting face 68 for engaging the right wall 21 of vertical slot as shown best in FIG. 10 to transmit torque from the key 10 to the key plug 80 as the key 10 is turned by a user in a clockwise direction 72 (FIGS. 4 and 10) to rotate the key plug 80 in lock core 82.

Bow 12 includes a first face 18 shown in FIG. 1 and an oppositely directed second face 20 shown in FIG. 2. It will be understood that the shape of bow 12 can be varied within the spirit and scope of the invention. The width 29 of the bow 12 is shown best in FIG. 2. In the illustrated embodiment, width 29 of key bow 12 is about 0.1427 inch (3.62 mm) which is greater than the 0.097 inch (2.46 mm) width of a typical key (not shown).

Blade 14 is appended to bow 12 at a base 27 of bow 12. As shown best in FIGS. 1 and 2, blade 14 includes a bitted portion 22, a bottom portion 24, and a laterally projecting offset portion 26 extending vertically between the upper bitted portion 22 and the lower bottom portion 24.

Bitted portion 22 is provided with bitting 28 (shown in FIGS. 1 and 3) which is configured to engage and lift reciprocable pin tumblers (such as pin tumblers 86 shown in FIG. 5) packed into a key plug 80 and a core 82 of cylinder lock 11 to enable actuation of the cylinder lock 11 in the conventional manner. Bitted portion 22 also includes an angled end portion 30 angled at about 45° with respect to the horizontal in the illustrated embodiment.

Blade 14 is weakened somewhat in its ability to withstand torque loading applied to the key 10 as it is turned to actuate cylinder lock 11 because of the thin-walled configuration and cross-sectional shape of offset portion 26 of blade 14. The cross-sectional shape of offset portion 26 is best seen on a large scale in FIG. 10. This thin-walled configuration of offset portion 26 is desirable even if it weakens the blade somewhat because it is hard to duplicate a key blade having such an offset portion 26 using conventional key-duplicating equipment. A key blade such as blade 14 is thus an important part of a high security cylinder lock assembly.

Advantageously, it is not necessary to rely on the use of the offset portion 26 or the bitted portion 22 of the blade 14 to transmit substantial torque to rotate key plug 80 in core 82 because the separate drive shoulder 16 is arranged and sized to provide a portion of the drive force for rotating the key plug 80. The bottom portion 24 of blade 14 also provides a portion of the drive force for rotating the key plug 80. Accordingly, the blade 14, and particularly offset portion 26 and bitted portion 22 of blade 14, is not required to have a configuration or mass designed to transmit a lot of torque during turning of the key 10 to rotate key plug 80 in core 82.

As shown in FIG. 2, bitted portion 22 includes a first face 32 aligned in coplanar relation with first face 18 of bow 12 and a second face 34 offset from second face 20 of bow 12. Second face 34 is curved to achieve a gradual transition between the maximum thickness 154 of the drive shoulder 16 shown in FIG. 8*a* and the thickness 29 of the bow 12 shown in FIG. 2.

Offset portion 26 is shown in FIG. 2 to include a top wall 38, an angled side wall 40, a vertical side wall 42, and an angled bottom wall 44. The lateral cross-sectional thickness 156 of each wall 40, 42 and 44 of offset portion 26 is much less than the lateral cross-sectional thickness 152 of the bitted portion 22 as shown best in FIG. 8*a*. Channel 46 is sized to receive a longitudinally extending, laterally projecting rib 41 of key plug 80 as shown best in FIG. 4. The elongated rib-receiving channel 46 converges to a point at base 27 of bow 12 as shown in FIGS. 1 and 3.

Figure 8B:
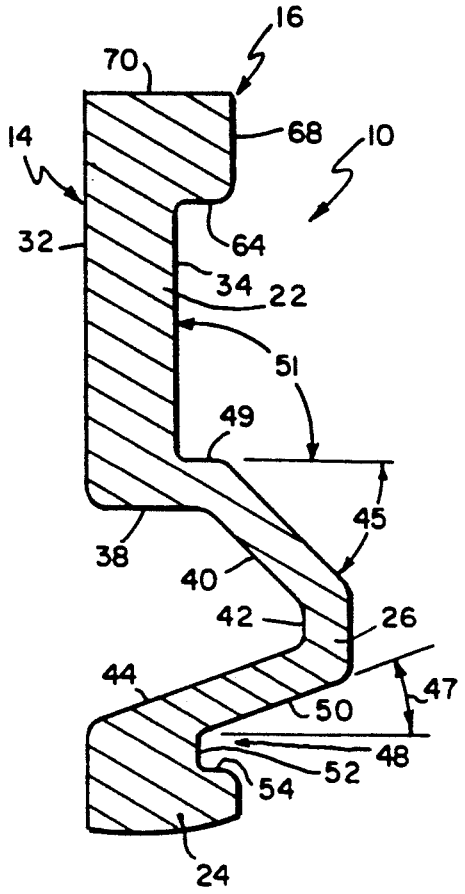
FIG. 8*b* is a view identical to FIG. 8*a* showing illustrative relative angles of the side wall and the bottom wall which make up the offset portion of the key.

As shown in FIG. 8*b*, side wall 40 of offset portion 26 has a steep slope and is angled at about an angle 45 as measured from the horizontal. Angle 45 is preferably about 43.5°. Angled bottom wall 44 of offset portion 26 has a more gentle slope and is angled approximately at an angle 47, which is preferably about 20.0° from the horizontal. In addition, the angle 51 included between second face 34 of bitted portion 22 and an upwardly facing surface 49 of top wall 38 of offset portion 26 is approximately 90°. Advantageously, it is much harder to insert picking tools into the cylinder lock 11 and manipulate such tools to pick lock 11 because the included angle 51 reduces the clearance space available for insertion of a pick or shim into the space underneath the tumbler pin stacks.

Bottom portion 24, like offset portion 26, is formed to include an elongated channel 48 along the length of blade 14. The channel 48 is defined by a downwardly facing surface 50 of an offset portion 26, a vertical wall 52, and an upwardly facing horizontal wall 54.

Key blade 14 includes a stop shoulder 56 formed at the distal end of offset portion 26 and bottom portion 24. Stop shoulder 56 has a stop surface 58 which is adapted to provide means for engaging an inner surface 60 of a C-shaped disk segment 118 or the like attached to key plug 80 during insertion of key blade 14 into the keyway 108 of cylinder lock 11 along an axis of insertion 62 as shown in FIG. 5. Stop shoulder 56 thus provides means for properly aligning and registering blade 14 within the keyway 108 provided in cylinder lock 11. In addition, as best shown in FIG. 5, stop shoulder 56 provides means on the blade 14 for aligning drive shoulder 16 relative to key plug 80 to position drive shoulder 16 in the vertical slot 19 formed in front face 13 outside keyway 108 to lie in confronting relation and in snug driving engagement to the right side wall 21 provided in key plug 80 of the cylinder lock 11 upon arrival of bitted portion 22 at a predetermined position underlying tumbler pin bores 110. Thus, drive shoulder 16 is used to impart rotational torque to the key plug 80 by turning key 10 to actuate the lock. Stop shoulder 56 also provides means for aligning the bitting 28 on the blade 14 properly underneath the stacks of pin tumblers 86 held in the lock core 82 and key plug 88 as will be further described with reference to FIG. 5.

The drive shoulder 16 of key 10 is positioned along the top edge of the key blade 14 between the bow 12 and the bitted portion 22. As shown in FIG. 2, drive shoulder 16 includes a bottom surface 64, a vertical drive-imparting surface 68, and a top surface 70. Drive shoulder 16 is shown in FIG. 2 to project laterally away from blade 14 in a direction corresponding to the direction of rotation of key 10 to actuate cylinder lock 11, that direction being indicated by a clockwise pointing arrow 72 on FIGS. 4 and 10. As shown, drive shoulder 16 is a beam appended to a top edge of key blade 14 at the throat of key 10 between blade 14 and bow 12.

As shown in FIGS. 4 and 7, drive shoulder 16 projects laterally away from second face 34 of blade 14 so that the drive-imparting surface 68 of drive shoulder 16 engages the driven shoulder provided by right side wall 21 of the vertical slot 19 formed in key plug 80 outside the mouth of keyway 108. In effect, drive shoulder 16 provides means for positioning the bitted portion 22 of blade 14 in spaced relation to the inner wall 105 of keyway 108 as shown best in FIG. 10 to delay driving contact between the bitted portion 22 and offset portion 26 of blade 14 and key plug 80 until after the key plug 80 has rotated in core 82 under primary torque force provided by the drive shoulder 16 and the bottom portion 24 of the blade 14. As shown best in FIG. 10, the bottom portion 24 includes a drive-imparting surface that engages a left side wall 73 in the keyway 108 (not in vertical slot 19) to transmit rotational torque along the length of blade 14 to the key plug 80 as key 10 is rotated about axis 62 in clockwise direction 72. Thus, the bitted portion 22 and the offset portion 26 of the blade 14 does not carry the primary torque transmission load between key 10 and key plug 80 during turning of key 10 to rotate key plug 80 in the core 82. Instead, the drive shoulder 16 and bottom portion 24 of blade 14 cooperate to carry the primary torque transmission load of key 10 to compensate for any torsional weakness of key 10 as a result of the thin-walled configuration of the offset portion 26 of key blade 14.

Figure 9:
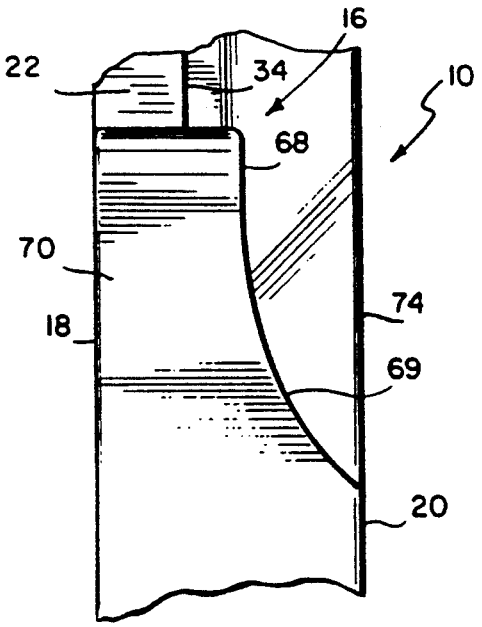
FIG. 9 is an enlarged view of the drive shoulder of the key taken along lines 9—9 of FIG. 1, with portions broken away, showing the flat drive-imparting surface of the drive shoulder.

Drive-imparting surface or portion 68 is an exterior side wall on a drive shoulder 16 and faces in a direction 72 as shown in FIG. 4. Drive-imparting surface 68 is substantially flat, as shown in FIG. 9, and mates with a gently curving transition section 69 as it approaches face 20 of bow 12 in similar fashion to second face 34 of bitted portion 22. Further, as shown in FIG. 7, drive-imparting surface 68 of drive shoulder 16 is configured to engage the driven shoulder provided on the right side wall 21 in the vertical slot 19 formed in key plug 80 in snug driving engagement as will be subsequently described to transmit torque from the key 10 to the key plug 80.

Illustrative dimensions for the key blade 14 are provided in FIG. 8*a*. As shown in FIG. 8*a*, a key blade 14 in accordance with the present invention has a thickness 150 of about 0.1427 inches (3.62 mm). Bitted portion 22 has a thickness 152 of about 0.0480 inch (1.22 mm). The drive-imparting surface 68 of drive shoulder 16 projects about 0.032 inch (0.813 mm) beyond the face 34 of bitted portion 22 such that the thickness 154 of drive shoulder 16 is about 0.08 inch (2.03 mm) +0.003 inch (0.76 mm) and −0.000 inch (0 mm). Offset portion 26 has a cross section width 156 of about 0.0250 inch (0.635 mm). This width 156 is very thin and reduces the torque-transmitting capability of key blade 14 somewhat as compared to relatively thicker conventional key blades (not shown). Bottom portion 24 has a thickness 158 of about 0.08 inch (2.03 mm) +0.003 inch (0.076 mm) −0.000 inch (0 mm).

As shown best in FIG. 2, a vertical face 74 of offset portion 26 lies in coplanar relation with second face 20 of bow 12, while top wall 38 and angled bottom wall 44 terminate in alignment with first face 18 of bow 12. Thus, the thickness 150 of the blade 14, shown best in FIG. 8*a*, is substantially equivalent to the width 29 of bow 12, shown best in FIG. 2. Thickness 150 of key blade 14 is greater than the 0.097 inch (2.46 mm) thickness of a conventional key (not shown).

However, the cross section width 156 of the offset portion 26 is, by contrast, less than that of a conventional key blade. Thus, it is possible that during normal use, without provision of a drive shoulder 16 on key 10, blade 14 might otherwise experience some flexure in excess of its elastic limit when torque is applied to bow 12 by a user and transmitted to blade 14 as the key 10 is turned to actuate cylinder lock 11.

By providing drive shoulder 16, the potential for exposing blade 14 to excessive flexure or breakage is minimized. Advantageously, drive-imparting surface 68 of drive shoulder 16 contacts the drive-receiving surface provided by right side wall 21 in the vertical slot 19 formed in key plug 80 when the key 10 is rotated in clockwise direction 72 in cylinder lock 11. Thus, it is the sturdy drive shoulder 16 and the sturdy bottom portion 24, not the somewhat fragile bitted portion 22 and offset portion 26 of key blade 14, which transmit most of the torque applied by a user from the bow 12 to the key plug 80.

Referring to FIG. 8*a*, the depth of the elongated channel 46 forming offset portion 26 in key blade 14 is defined by the dimension 160. In the illustrated embodiment, the depth 160 is 0.1177 inch (2.99 mm). Advantageously, this depth 160 is greater than the 0.097 inch (2.46 mm) thickness of a conventional key.

Bitted portion 22 has a maximum height represented by a dimension 162 of about 0.140 inch (3.56 mm). Offset portion 26 has a height 164 of about 0.1425 inch (3.62 mm), and bottom portion 24 has a height 166 of about 0.0585 inch (1.49 mm). Vertical face 74 of offset portion 26 has a height 168 of about 0.0509 inch (1.29 mm). Vertical wall 52 of bottom portion 24 has a height 170 of about 0.174 inch (4.42 mm).

It will be understood that the foregoing dimensions of key 10 are provided to define the illustrated embodiment with precision. The dimensions can be varied within the scope of the invention.

The core 82 of cylindrical lock 11 is illustrated in FIG. 4. Core 82 may be a figure-8-shaped removable core as described, for example, in U.S. Pat. No. 4,294,093. Such a core is adapted to be mounted in a standard cylindrical receptacle (not shown). Core 82 has an upper lobe 84 which contains stacks of pin tumblers 86 (shown in FIG. 5) and a lower lobe 88 in which a key plug 80 is rotatably mounted. The core 82 also has a figure-8-shaped face plate 90 which is formed to include a circular front opening in its lower lobe front opening for receipt of the key plug 80 and its circular front face 13. A movable control lug 94 is provided for normally retaining the core 82 in its receptacle.

As shown best in FIG. 5, key plug 80 is rotatably mounted in a sleeve 96 within core 82. Key plug 80 is rotatable about an axis of rotation 81. Sleeve 96 carries control lug 94 and is mounted for limited rotation in a bore 97 formed in core 82 to move control lug 94 from a core-retaining position to a core-releasing position upon insertion and rotation of a control key (not shown) by a user wishing to remove core 82 from its receptacle.

Referring to FIG. 5, key plug 80 includes a cylindrical body portion 98. The front face 13 is attached to a forward end of the key plug 80. Attached to a rearward end 100 of body portion 98 is a rearward peripheral flange 102 which overlaps the end of sleeve 96. The vertical slot 19 is formed in key plug 80 so that the right side wall 21 is located so as to be normally aligned in snug engagement with drive-imparting surface 68 of the drive shoulder 16 on key 10 following full insertion of key blade 14 into the keyway 108.

Key plug 80 is also formed to include a keyway 108 extending longitudinally therethrough from the rearward end of vertical slot 19 toward the rearward end of the key plug 80. The keyway 108 is sized to receive blade 14 of key 10 when the key 10 is inserted first through vertical slot 19 and then into keyway 108 along longitudinal axis of insertion 62. Longitudinal axis of insertion 62 lies in a longitudinal plane of insertion. The plane of insertion extends between the "twelve o'clock" and "six o'clock" positions of lower lobe 88.

The plurality of tumbler pin bores 110 extend through core 82, sleeve 96, and key plug 80 to open into keyway 108. Positioned in each of the bores 110 is a stack of pin tumblers 86 biased by respective springs 112 in the conventional manner. The drive-imparting surface 68 of key 10 is positioned about midway between the front opening of vertical slot 19 and the first of these tumbler pin bores 110 when the key blade 14 is fully inserted into keyway 108 as illustrated in FIG. 5.

When a key 10 having the appropriate bitted portion 22 is inserted into keyway 108 in the correct orientation and moved forward so that the stop shoulder 56 engages disk 118, the bitting 28 engages the lowermost pin tumbler 86 in each respective bore 110 and raises and aligns the tumblers 86 to form a shear plane 114 as shown in FIG. 5. Key plug 80 is then free to rotate relative to sleeve 96 to actuate the locking mechanism of cylinder lock 11 upon the application of sufficient torque to key 10 by the user.

Peripheral flange 102 is formed to include a slot 116 sized to receive a C-shaped disk segment 118. Disk segment 118 includes the surface 60 directed toward the keyway 108. As shown in FIG. 5, stop surface 58 on key 10 engages surface 60 of disk segment 118 when key blade 14 is inserted into keyway 108 along axis of insertion 62, thereby limiting additional axial movement of key blade 14 along the axis of insertion 62. Stop surface 58 thus serves to provide means for placing the bitted portion 22 of key blade 14 into registered alignment with tumbler pins 86. Additionally, stop surface 58 serves as means for aligning drive-imparting surface 68 of drive shoulder 16 with a drive-receiving surface provided by right side wall 21 in the vertical slot 19 formed in key plug 80 so that torque is correctly transmitted from key 10 to key plug 80 to rotate key plug 80 relative to sleeve 96. As noted above, the bottom portion 24 also functions to transmit torque from key 10 to key plug 80 during turning of key 10. Drive shoulder 16 does not serve to limit axial movement of key 10 into keyway 108 because such stop means is provided by stop shoulder 56 at the distal tip of blade 14.

Another view of C-shaped disk segment 118 is shown in FIG. 6. Also shown is a pair of eccentric bores 120 formed in key plug 80. The bores 120 are positioned to receive a pair of throw pins on a throw pin assembly (not shown). The throw pin assembly is fixed to a cam for transmitting key plug rotation to a secondary lock mechanism (not shown) in a conventional manner.

As also shown in FIG. 6, a fantail slot 120 formed in upper lobe 84 lies in communication with bore 97 in which sleeve 96 is rotatably mounted. A boss 122 appended to sleeve 96 is movable in the fantail slot 120 between lock core-retaining position (as shown) and a lock core-releasing position (not shown). In the core-releasing position, boss 122 retracts into fantail slot 120 to move control lug 94 to a non-projecting position.

In FIG. 7, drive-imparting surface 68 is shown in alignment with drive-receiving surface provided by right side wall 21 in the vertical slot formed in key plug 80. When a user applies torque to bow 12 in the direction indicated by clockwise arrow 72, drive-imparting surface 68 bears against drive-receiving surface 21 in slot 19 to rotate key plug 80 relative to core 82 in clockwise direction 72.

To summarize, in operation of an apparatus in accordance with the present invention, key 10 is inserted by a user through the outer slot 19 and then into keyway 108 along axis of insertion 62. Key 10 can be inserted to the point at which stop surface 58 of stop shoulder 56 engages surface 60 of C-shaped disk segment 118.

Stop shoulder 56 thus assists in providing means for properly aligning key 10 in keyway 108. That is, bitted portion 22 is aligned properly with tumbler pins 86, ensuring that bitting 28 lifts tumbler pins 86 so as to form shear plane 114 properly. In addition, drive-imparting surface 68 of drive shoulder 16 is placed in alignment with drive-receiving surface 21 of key plug 80.

The user now can turn key 10 in clockwise direction 72 (see FIG. 4) to actuate the lock. Specifically, the turning of key 10 in direction 72 brings drive-imparting surface 68 into engagement with drive-receiving surface 21 in the slot 19 formed in the key plug 80. Key plug 80 is thus cammed to rotate about axis 62 relative to lock core 82. Key plug 80 is free to rotate in such fashion because tumbler pins 86 are aligned vertically to form shear plane 114 as referred to above.

Rotation of key plug 80 causes rotation of throw pins (not shown) which are received in bores 120. The throw pins transmit key plug rotation to a secondary locking mechanism (not shown) as has been previously noted.

If key 10 is configured as a control key instead of an operating key, rotation of key 10 will cause movement of control lug 94 into fantail slot 120. This allows core 82 to be removed from the cylinder lock assembly in the conventional fashion.

Although the invention has been described in detail with reference to certain preferred embodiments, variations and modifications exist within the scope and spirit of the invention as described and defined in the following claims.

What is claimed is:

1. A cylinder lock assembly including an interchangeable lock core, the assembly comprising a sleeve carrying a control lug movable between a core-retaining position and a core-releasing position, the sleeve being mounted to rotate in the lock core to move the control lug between the core-retaining and core-releasing positions, a key plug formed to include a keyway and mounted for rotation in the sleeve, and a key having a bow, a blade appended to the bow, stop means for limiting inward travel of the blade into the keyway, and drive shoulder means for transmitting torque from the key to the key plug to rotate the key plug in the sleeve, the stop means and the drive shoulder means being situated in spaced-apart relation, the blade including a top edge, a bottom edge, a thin-walled offset portion producing a weakening of the blade and extending between the top and bottom edges along the length of the blade and extending between the stop means and the drive shoulder means, the bottom edge having a cross-sectional width greater than the cross-sectional width of the thin-walled offset portion, the drive shoulder means having a selected cross-sectional width greater than the cross-sectional width of the thin-walled offset portion, and the bow having a cross-sectional width greater than the selected cross-sectional width of the drive shoulder means, and the bottom edge, a proximal end appended to the bow, and a distal tip, the stop means being situated at the distal tip.

2. The assembly of claim 1, wherein the sleeve is formed to include a plurality of spaced bores, the key plug is formed to include a plurality of tumbler pin bores opening into the keyway and opening into said bores formed in the sleeve, the key includes means formed on the blade for lifting tumbler pins reciprocably mounted in the tumbler pin bores, and the lifting means is situated on the blade to lie between the stop means and the drive shoulder means and above the thin-walled offset portion.

3. The assembly of claim 2, wherein the bottom edge includes the stop means, and the top edge is formed to include the lifting means and the drive shoulder means.

4. A cylinder lock assembly comprising an interchangeable core, a sleeve carrying a control lug movable between a core-retaining position and a core-releasing position, the sleeve being mounted to rotate in the interchangeable core to move the control lug between core-retaining and core-releasing positions, a key plug mounted for rotation in the sleeve, the key plug being formed to include a keyway and including a drive-receiving surface situated outside of the keyway, and a key having a bow, drive shoulder means for engaging the drive-receiving surface of the key plug to rotate the key plug relative to the sleeve and core in response to turning of the key in the keyway, and a blade appended to the bow, the blade including stop means for positioning the drive shoulder means outside the keyway in alignment with the drive-receiving surface of the key plug during insertion of the blade into the keyway, the stop means being situated in spaced-apart relation to the drive shoulder means, the blade further including a top edge, a bottom edge, at thin-walled offset portion producing a weakening of the blade and extending between the top and bottom edges along the length of the blade and extending between the stop means and the drive shoulder means, the bottom edge having a cross-sectional width greater than the cross-sectional width of the thin-walled offset portion, the drive shoulder means having a selected cross-sectional width greater than the cross-sectional width of the thin-walled offset portion, and the bow having a cross-sectional width greater than the selected cross-sectional width of the drive shoulder means and the bottom edge.

5. The assembly of claim 4, wherein the key plug is formed to include an outer slot outside of the keyway, the drive-receiving surface defines a side wall of the outer slot in the key plug, and the drive shoulder means is positioned by the stop means to lie in the outer slot and to place the drive shoulder means in alignment with the drive-receiving surface upon insertion of the blade through the outer slot into the keyway.

6. The assembly of claim 5, wherein the blade includes a bitted portion and the drive shoulder means is located between the bitted portion and the bow.

7. The assembly of claim 6, wherein the top edge is formed to include the bitted portion, and the drive shoulder means extends above the bitted portion on the top edge of the blade in a direction away from the bottom edge.

8. The assembly of claim 7, wherein the stop means is located on the bottom edge of the blade.

9. The assembly of claim 5, wherein the top edge is formed to include a bitted portion, and the drive shoulder means extends above the bitted portion on the top edge of the blade in a direction away from the bottom edge to project into the outer slot and lie in confronting relation to the drive-receiving surface in the outer slot.

10. The assembly of claim 9, wherein the stop means is located on the bottom edge of the blade.

11. The assembly of claim 4, wherein the blade includes a bottom portion engaging the key plug in a lower region of the keyway and a bitted portion, and the thin-walled offset portion extends between the bitted and bottom portions, and the stop means is located on the bottom portion.

12. The assembly of claim 11, wherein the blade includes a top edge formed to include the bitted portion and the drive shoulder means is located between the bitted portion and the bow and above the thin-walled offset portion.

13. The assembly of claim 4, wherein the blade includes a proximal end appended to the bow and a distal tip and the stop means is situated at the distal tip.

14. The assembly of claim 4, wherein the blade includes a bottom edge including the stop means and a top edge including a bitted portion and the drive shoulder means and the thin-walled offset portion lies between the top and bottom edges.

15. The assembly of claim 14, wherein the key blade and keyway are proportioned and configured such that the bitted portion formed in the top edge of the blade does not have a substantial driving engagement along its length with the key plug.

16. The assembly of claim 4, further comprising a face plate located adjacent to the key plug and formed to include a front mouth of the keyway, and wherein the key plug is formed to include a plurality of tumbler pin bores opening into the keyway and the drive shoulder means is located about midway between the face plate and the first of the tumbler pin bores.

17. A cylinder lock assembly comprising an interchangeable core, a sleeve carrying a control lug movable between a core-retaining position and a core-releasing position, the sleeve being mounted to rotate in the lock core to move the control lug between core-retaining and core-releasing positions, a key plug mounted for rotation in the sleeve, the key plug being formed to include a vertically elongated, laterally narrow slotted keyway and a plurality of tumbler pin bores opening into the keyway, and a key having a bow, a blade appended to the bow, the blade including a top edge formed to include a single bitted portion, and drive means for providing the primary torque force to rotate the key plug relative to the sleeve and core to actuate the cylinder lock assembly in response to turning of the key in the keyway, said drive means and the key plug being proportioned and configured such that said drive means drivingly engages said key plug and serves as the primary drive force for rotating the key plug in the sleeve, said drive means including a drive shoulder extending above said single bitted portion of the top edge, the key further including stop means for limiting inward travel of the key blade into the keyway and the stop means being situated in spaced-apart relation to the drive shoulder, the blade including a proximal end appended to the bow and a distal tip and the stop means is situated at the distal tip, the drive shoulder being appended to the proximal end of the blade, and the drive means further including a bottom edge along the length of the blade, the blade including a thin-walled offset portion producing a weakening of the blade and extending between the top and bottom edges along the length of the key blade, the bow having a cross-sectional width greater than the cross-sectional width of the drive shoulder and the bottom edge, and each of the bottom edge and the drive shoulder having a cross-sectional width greater than the cross-sectional width of the thin-walled offset portion to rigidify the key to reduce twisting of the key about its longitudinal axis as it is turned in the keyway to rotate the key plug, thereby enhancing torque-transmitting properties of the key.

18. A cylinder lock assembly comprising a core, a key plug mounted in the core, the key plug being formed to include a keyway and a plurality of tumbler pin bores opening into the keyway, and a key having a bow, a blade appended to the bow, the blade including a top edge formed to include a single bitted portion and drive means for providing the primary torque force to rotate the key plug relative to the core to actuate the cylinder lock assembly in response to turning of the key in the keyway, said drive means and the key plug being proportioned and configured such that said drive means drivingly engages said key plug and serves as the primary drive force for rotating the key plug, said drive means including a drive shoulder extending above said top edge single bitted portion, the drive means further includes a bottom edge along the length of the blade, the blade includes a thin-walled offset portion producing a weakening of the blade and extending between the top and bottom edges along the length of the blade, the bow having a cross-sectional width greater than the cross-sectional width of the drive shoulder and the bottom edge, and each of the bottom edge and the drive shoulder have a cross-sectional width greater than the cross-sectional width of the thin-walled offset portion to rigidify the key to reduce twisting of the key about its longitudinal axis as it is turned in the keyway to rotate the key plug, thereby enhancing torque-transmitting properties of the key.

19. The assembly of claim 18, wherein the drive shoulder is located on the top edge of the blade to lie between the bitted portion and the bow.

20. The assembly of claim 19, wherein the key plug is formed to include slot means for receiving the drive shoulder upon insertion of the blade into the keyway, the slot means includes side wall means for engaging the drive shoulder as the key is turned in the keyway so that the key plug rotates in the core in response to turning of the key in the keyway, and the blade further includes stop means for limiting inward travel of the blade into the keyway to position the drive shoulder outside of the keyway in the slot means in confronting relation to the side wall means so that the drive shoulder and bottom edge cooperate to engage and rotate the key plug in the core in response to turning of the key in the keyway without substantial flexing and twisting the thin-walled offset portion of the blade.

21. For use with a cylinder lock assembly including an interchangeable core, a key plug rotatable in the core, the key plug being formed to include a keyway and a row of tumbler pin bores opening downwardly into the keyway, tumbler pins reciprocally mounted in said pin bores from a position inhibiting relative rotation between the key plug and the core to a position allowing relative rotation between the key plug and the core and from a position inhibiting relative rotation between the core and the lock assembly to a position allowing relative rotation between the core and the lock assembly, a key comprising a bow, a blade appended to the bow, means formed on the blade for lifting said tumbler pins reciprocally mounted in the tumbler pin bores, and drive means for providing the primary driving force for rotating the key plug to actuate the cylinder lock assembly, said drive means including a drive shoulder located vertically above the lifting means and between the lifting means and the bow, the blade including a top edge formed to include the lifting means and the drive shoulder, a bottom edge, and a thin-walled offset portion producing a weakening of the blade and extending between the top and bottom edges along the length of the blade, blade-rigidifying means for providing each of the bottom edge and the drive shoulder with a cross-sectional width greater than the cross-sectional width of the thin-walled offset portion to rigidify the blade along its longitudinal axis, the bow having a cross-sectional width greater than the cross-sectional width of the drive shoulder and the bottom edge.

22. The key of claim 21, wherein the bottom edge engages the key plug in a lower region of the keyway, and the drive shoulder is appended to the top edge.

23. The key of claim 21, wherein the key plug includes a plane of insertion extending longitudinally therethrough and a drive-receiving surface, the drive shoulder includes a drive-imparting surface lying in a plane oriented parallel to the plane of insertion, and the drive-imparting surface is configured to engage the drive-receiving surface in response to turning of the key in the keyway.

24. The key of claim 21, wherein the cross-sectional width of the bow is a predetermined dimension, the cross-sectional width of the drive shoulder is about four-sevenths of the cross-sectional width of the bow, and the cross-sectional width of the thin-walled offset portion is about one-third of the cross-sectional width of the drive shoulder.

25. The key of claim 24, wherein the cross-sectional width of the bow is about 0.1427 inch (3.62 mm), the cross-sectional width of the drive shoulder is about 0.080 inch (2.03 mm), and the cross-sectional width of the thin-walled offset portion is about 0.025 inch (0.635 mm).

26. The key of claim 25, wherein the cross-sectional width of the bottom edge is about 0.080 inch (2.03 mm).

27. The key of claim 21, wherein the cross-sectional width of the bow is about 0.1427 inch (3.62 mm), the cross-sectional width of the drive shoulder is about 0.080 inch (2.03 mm), and the cross-sectional width of the thin-walled offset portion is about 0.025 inch (0.635 mm).

28. The key of claim 27, wherein the cross-sectional width of the bottom edge is about 0.080 inch (2.03 mm).

29. For use with a cylinder lock assembly including an interchangeable core, a key plug rotatable in the core, the key plug being formed to include a keyway and a row of tumbler pin bores opening downwardly into the keyway, tumbler pins reciprocally mounted in said pin bores from a position inhibiting relative rotation between the key plug and the core to a position allowing relative rotation between the key plug and the core, a key comprising a bow, a blade appended to the bow, means formed on the blade for lifting said tumbler pins reciprocally mounted in the tumbler pin bores, the blade including a top edge formed to include the lifting means, a bottom edge, and a thin-walled offset portion producing a weakening of the blade and extending between the top and bottom edges along the length of the blade, and a drive shoulder located on the top edge of the blade between the lifting means and the bow, the drive shoulder rising vertically above the lifting means and including a forward portion adjacent to the lifting means, a rearward portion adjacent to the bow, first and second laterally spaced-apart, exterior, vertical surfaces extending between the forward and rearward portions, and primary drive force means for providing a drive-imparting portion positioned on the first exterior vertical surface to engage and rotate the key plug so as to actuate the cylinder lock assembly and to lie in laterally spaced-apart relation to the second exterior vertical surface, the bottom edge having a cross-sectional width greater than the cross-sectional width of the thin-walled offset portion, the drive shoulder having a selected cross-sectional width between the second exterior vertical surface and the drive-imparting portion on the first exterior vertical surface greater than the cross-sectional width of the thin-walled offset portion, and the bow having a cross-sectional width greater than the selected cross-sectional width of the drive shoulder.

30. The key of claim 29, further comprising stop means for engaging a portion of the key plug to limit inward travel of the blade into the keyway and wherein the blade includes a proximal end appended to the bow and a distal tip and the stop means is situated at the distal tip.

31. The key of claim 29, further comprising stop means for engaging a portion of the key plug to limit inward travel of the blade into the keyway and wherein the lifting means is situated on the blade to lie between the stop means and the drive shoulder.

32. The key of claim 29, wherein the key blade and keyway are proportioned and configured such that the lifting means along the top edge of the blade does not have a substantial driving engagement along its length with the key plug.

33. The key of claim 29, wherein the cross-sectional width of the bow is a predetermined dimension, the cross-sectional width of the drive shoulder is about four-sevenths of the cross-sectional width of the bow, and the cross-sectional width of the thin-walled offset portion is about one-third of the cross-sectional width of the drive shoulder.

34. The key of claim 33, wherein the cross-sectional width of the bow is about 0.1427 inch (3.62 mm), the cross-sectional width of the drive shoulder is about 0.080 inch (2.03 mm), and the cross-sectional width of the thin-walled offset portion is about 0.025 inch (0.635 mm).

35. The key o claim 34, wherein the cross-sectional width of the bottom edge is about 0.080 inch (2.03 mm).

36. The key of claim 29, wherein the cross-sectional width of the bow is about 0.1427 inch (3.62 mm), the cross-sectional width of the drive shoulder is about 0.080 inch (2.03 mm), and the cross-sectional width of the thin-walled offset portion is about 0.025 inch (0.635 mm).

37. The key of claim 36, wherein the cross-sectional width of the bottom edge is about 0.080 inch (2.03 mm).

* * * * *